US005918646A

United States Patent [19]

Covelli

[11] Patent Number: 5,918,646

[45] Date of Patent: Jul. 6, 1999

[54] ELECTROMAGNET WEFT BRAKE FOR WEFT FENDER

[75] Inventor: Marco Covelli, Occhieppo Inferiore, Italy

[73] Assignee: Nuova Roj Electrotex S.r.l., Biella, Italy

[21] Appl. No.: 08/849,880

[22] PCT Filed: Dec. 4, 1995

[86] PCT No.: PCT/EP95/04765

§ 371 Date: Jun. 18, 1997

§ 102(e) Date: Jun. 18, 1997

[87] PCT Pub. No.: WO96/19605

PCT Pub. Date: Jun. 27, 1996

[30] Foreign Application Priority Data

Dec. 22, 1994 [IT] Italy ..... MI94A2607

[51] Int. Cl.[6] ..... D03D 47/36

[52] U.S. Cl. ..... 139/452; 242/365.4; 335/257

[58] Field of Search ..... 242/47.01, 365.3, 242/365.4; 139/452; 335/257, 255

[56] References Cited

U.S. PATENT DOCUMENTS

| | | | |
|---|---|---|---|
| 4,632,155 | 12/1986 | Maina | 139/452 |
| 4,811,762 | 3/1989 | Bucher et al. | 139/452 |
| 5,271,435 | 12/1993 | Maina | 139/452 |
| 5,462,096 | 10/1995 | Svanstroem et al. | 139/452 |

FOREIGN PATENT DOCUMENTS

| | | |
|---|---|---|
| 0 174 039 | 3/1986 | European Pat. Off. . |
| 0 239 055 | 9/1987 | European Pat. Off. . |
| 0 363 938 | 4/1990 | European Pat. Off. . |
| 0 436 197 | 7/1991 | European Pat. Off. . |
| 0 441 288 | 8/1991 | European Pat. Off. . |
| 0 581 745 | 2/1994 | European Pat. Off. . |

*Primary Examiner*—Andy Falik
*Attorney, Agent, or Firm*—Young & Thompson

[57] ABSTRACT

An electromagnetic unit to stop the weft yarn in measuring weft feeders for fluid jet looms, includes a rod movable along its axis under the control of at least one electromagnetic coil so as to insert one of its ends, with slack, into a corresponding hole of the weft feeder drum and engage with that end the weft yarn on the side to stop its unwinding from the drum. Onto the movable end of the rod engaging the weft yarn a bush is mounted for mating with the edge of the drum hole for insertion of the rod end, and the sliding of the bush towards the drum taking place with delay in respect of the movement of the rod towards the drum.

10 Claims, 5 Drawing Sheets

ELECTROMAGNET WEFT BRAKE FOR WEFT FENDER

FIELD OF THE INVENTION

The present invention concerns improvements in measuring weft feeders for fluid jet looms i.e. those special feeders wherein the weft yarn, wound so as to form a reserve around a drum kept motionless, is drawn by the loom through a main nozzle and is measured, while being unwound from said drum, with a system counting the yarn turns which have been drawn.

In such feeders, the unwinding of the weft yarn is normally stopped by means of an electromagnetic unit, a rod connected to its movable core being apt to engage the outlet end of the weft feeder drum by penetrating with slack into a hole, generally slotted, formed in said drum The present invention proposes to improve in said measuring weft feeders the performances of said electromagnetic weft yarn stopping unit, so as to block—more efficiently than done so far with the known units—the weft yarn soon after it has stopped and, particularly, upon cutting thereof by the cutting devices provided on the loom.

FIELD OF THE INVENTION

In the last years various improvements have already been introduced by the Applicant in the electromagnetic yarn stopping units of measuring weft feeders for fluid jet looms, so as to improve their performances and make them more suited to the increasingly hard conditions of use to which they are subjected.

BACKGROUND OF THE INVENTION

Such improvements are described in IT-U-9044, in IT-U-209674 and above all, in the more recent EP-363.938 wherein, to allow eliminating dangerous rebounds and make the operating times more uniform, the electromagnetic unit has two coils, so that the movable core to stop the weft yarn is controlled both to take up its working position and to take up its position of rest.

Though the performances of the electromagnetic stopping unit have thus been improved, the situation is still critical when the weft yarn is being cut by the loom cutting device positioned at the outlet of the main nozzle feeding the weft yarn into the loom shed.

In fact, in this step there is a sudden change of weft yarn tension causing oscillations along the tensioned yarn, which return from its cut end up to the point in which the yarn has been blocked by the rod of the electromagnetic stopping unit, and which may continue up to reaching the turns wound on the weft feeder drum.

Such oscillations, which produce on the yarn strong transversal and longitudinal waves, can cause said yarn to wedge under the rod of the electromagnetic stopping unit—in a working position into the drum hole—even after the yarn has stopped against said rod; they can also cause ruffling of the yarn turns wound in the area of its outlet from the feeder drum, close to said electromagnetic stopping unit.

This behavior obviously determines an incorrect measuring of the weft yarn length being inserted into the loom, producing faults which may have different consequences, but which always involve damages.

In fact, a general consequence is that a yarn turn may end up by sliding under the rod of the electromagnetic stopping unit (in particular cases it could even be more than one turn) after the weft yarn has been inserted into the loom, and this could lead to a successive weft yarn insertion including a yarn length which is longer than one turn—in case of a single-colored weave—or else it could lead to the simultaneous insertion of a one color turn with a different color turn, in case of a many-colored weave.

This drawback is particularly felt in the case of a many-colored weave, in that it can show up when changing of the color takes place, in the form of an insertion corresponding to one or more turns, together with the next color and in the same shed, with no possibility of being detected by the weft yarn control systems used at present on fluid jet looms.

To overcome this drawback the EP-239.055, filed by the Applicant, supplied a device to be applied at the outlet of measuring weft feeders, apt to greatly dampen the oscillating and vibratory motion of the weft yarn at the outlet of said feeder, particularly upon cutting of the yarn.

Said solution, making use of an additional device, resulted however uneconomic and, quite often, not very convenient for the user.

The Applicant then adopted a particular arrangement for the drum hole into which engages the rod of the electromagnetic stopping unit. According to this solution, described in EP-441.288, a plurality of bristles is positioned into said hole, transversally to the rod of the unit, to allow said rod to engage said bristles and move at least partially through them when taking up its projecting position to stop the yarn.

Said arrangement no doubt represents a valid solution to prevent the weft yarn from sliding under the rod of the electromagnetic stopping unit, in that the bristles form a real barrier which blocks the passage of said yarn. It nevertheless still represents an extra device, added to the other parts of the measuring weft feeder and, in particular, to that part of the yarn reserve drum which carries the hole into which engages the rod of the electromagnetic stopping unit; furthermore, said arrangement is anyhow not apt to eliminate the loosening and consequent ruffling and crossing of the yarn turns wound on the drum.

The present invention now proposes to solve the above problem at the root, by suitably improving the electromagnetic stopping unit without using any additional devices.

SUMMARY OF THE INVENTION

For this purpose, the invention supplies an electromagnetic unit to stop the weft yarn in measuring weft feeders for fluid jet looms—of the type comprising a rod movable along its axis, under the control of at least one electromagnetic coil, so as to insert one of its ends, with slack, into a corresponding hole of the weft feeder drum and engage the weft yarn on the side—characterized in that, onto said movable rod end engaging the weft yarn there is mounted a bush, axially slidable under the contrasting actions of supplementary electromagnetic coils and/or of spring means, said bush being apt to mate with the edge of the drum hole for insertion of said rod end, and the sliding of said bush towards the drum taking place with delay in respect of the movement of said rod towards the drum.

The invention also provides that the bush includes a first annular element of non-magnetic material, designed to mate with the edge of the drum hole apt to house the movable rod end, and a second annular element of magnetic material, fixed to the first and subject to the actions of said supplementary coils and/or of said spring means.

BRIEF DESCRIPTION OF THE DRAWINGS

The invention is now described in further detail, with reference to some preferred embodiments thereof, illustrated on the accompanying drawings in which.

DETAILED DESCRIPTION OF THE INVENTION

Figure 1:
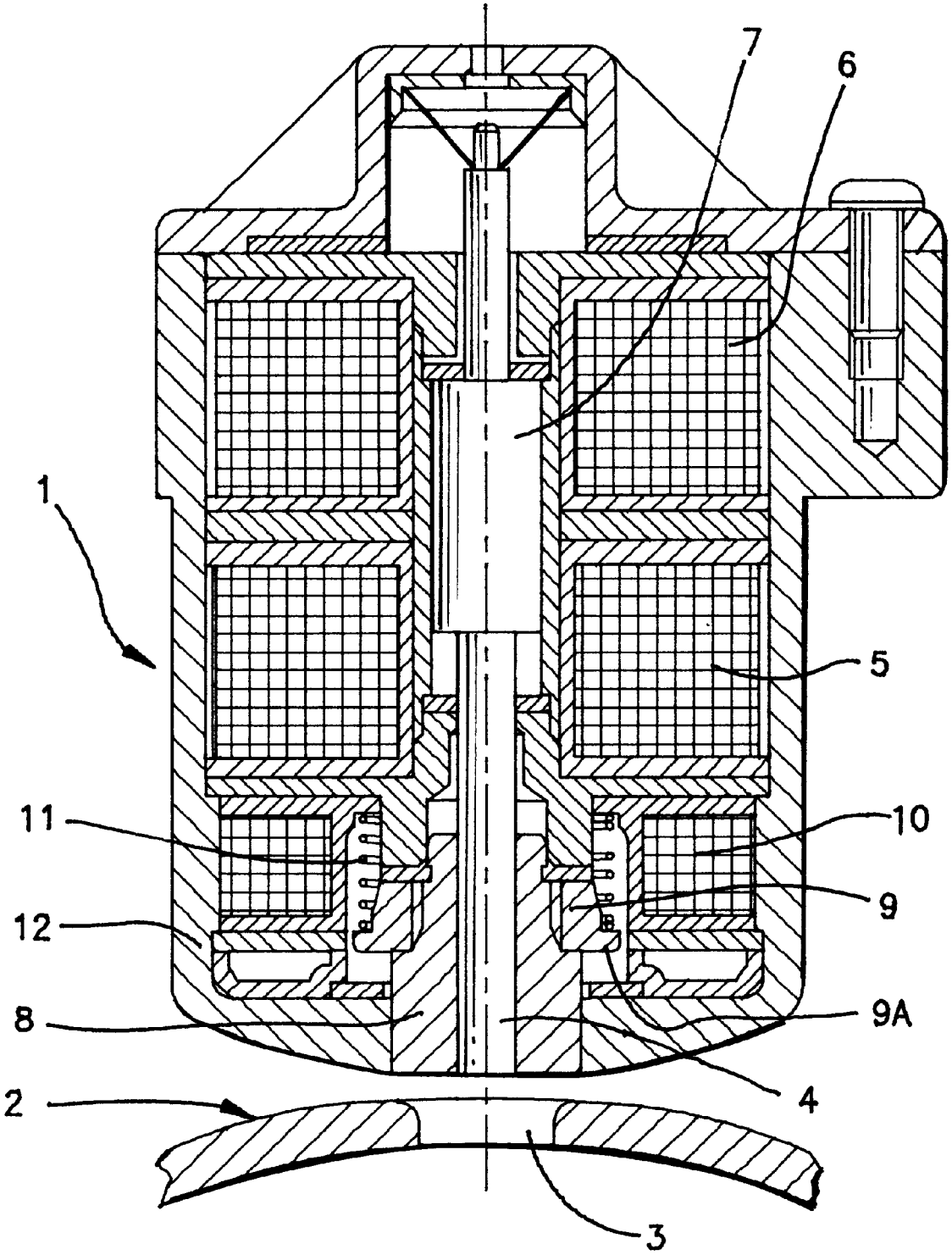
FIG. 1 is a diagrammatic axial section view of a first embodiment of the electromagnetic weft yarn stopping unit according to the present invention.

As shown in FIG. 1, the electromagnetic unit 1 to stop the weft yarn in measuring weft feeders for fluid jet looms is positioned next to the zone 2 of the yarn winding drum of said feeder, into which there is formed a hole 3 whose axis generally coincides with the axis of said electromagnetic unit 1.

In known manner, the movable part of the electromagnetic unit 1 consists of a rod 4 apt to perform a vertical movement under the control of two electromagnetic coils 5 and 6 which, by alternately generating a magnetic flux which runs through a movable core 7 to which the rod 4 is connected, cause the shifting of said rod between its two end-of-stroke positions (namely, the working position and the position of rest).

According to the invention, in addition to said known elements, the lower part of the unit 1—which practically faces the drum zone 2—comprises moreover a bush 8-9, sliding axially along the rod 4, as well as means 10 and 11, apt to control the sliding of said bush. The bush 8–9 comprises a first annular element 8 of non-magnetic material, coaxial and external to the rod 4 and slidable both in respect of the box 12 housing the unit I and in respect of said rod 4, and a second annular element 9 of magnetic material, fixed to the inner end of said first element 8. The means to control the sliding movements of the bush 8-9 comprise in turn a supplementary coil 10, coaxial to the coils 5 and 6 and closer than said coils to the drum zone 2, and a cylindrical helical spring 11 which presses the bush 8-9, engaging its collar 9A, towards said drum zone 2.

When the coil 10 is de-energized, the spring 11 presses the annular bush element 8, causing it to mate with the drum hole 3; whereas, the energizing of the coil 10 generates a magnetic flux which causes the axial movement of the annular element 9, and consequently of the bush 8-9, so as to withdraw this latter from the drum 2. The coil 10 is de-energized with some delay in respect of the energizing of the coil 5 which controls the movement of the rod 4, so that the weft yarn is first engaged by the rod 4 and then by the annular element 8 of the bush 8-9.

In the condition of weft yarn unwinding from the reserve wound on the drum, to feed the loom, both the rod 4 and the annular element 8 of the electromagnetic stopping unit 1 of the present invention are in the position shown in FIG. 1, namely in a position such as not to interfere in the least with the space existing between said unit 1 and the feeder drum; the rod 4 is in fact kept withdrawn by the coil 6, while the bush 8-9 is kept withdrawn by the supplementary coil 10.

Figure 2:
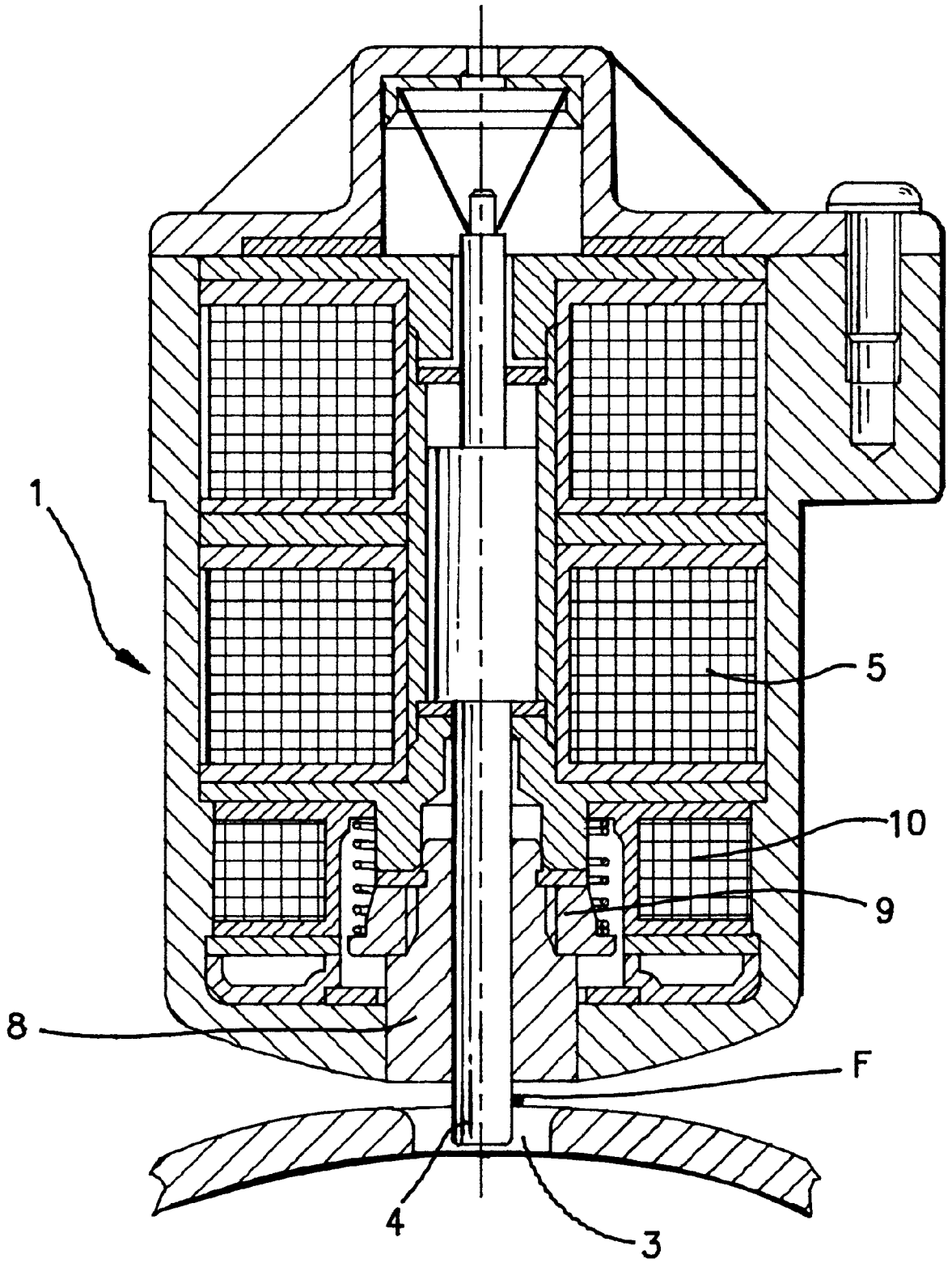
FIGS. 2 and 3 are views similar to that of FIG. 1, illustrating two working steps of said unit.

FIG. 2 shows instead the weft yarn stopping condition wherein the weft yarn F—shown in section—has been stopped against the rod 4 of the electromagnetic unit 1. In fact the rod 4 has emerged from said unit 1 to take up the position in which it engages the yarn F into the drum hole 3, due to the action of the magnetic field generated by energizing the coil 5. In this condition, the bush 8-9 is still inside the electromagnetic unit 1 under the control of the supplementary coil 10 which is energized.

In the phase just following said stopping condition, the heretofore described phenomenon of vibration on the weft yarn F could arise, causing said yarn to slide under the rod 4. In fact, in this condition, the yarn could easily penetrate into the hole 3 due to the clearance existing between the inner walls of said hole and the rod 4; the vibration could even produce yarn rebounds upstream of its stopping point, with a possible superposition of the turns still unwound and consequent problems in unwinding the reserve.

The already described arrangement, which characterizes the invention, allows to fully overcome these drawbacks.

Figure 3:
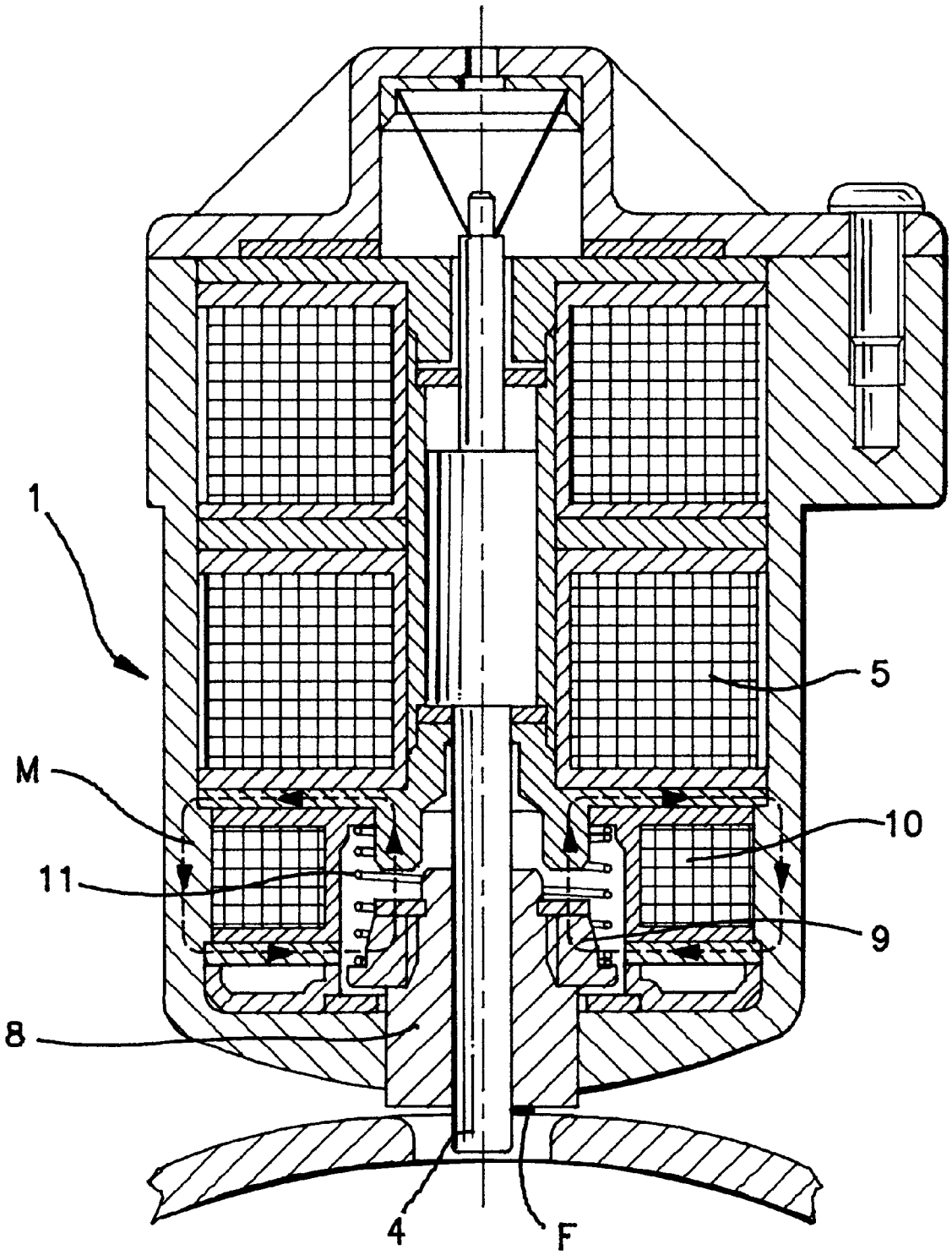

In fact, as shown in FIG. 3—which illustrates the situation just after stopping of the weft yarn—the de-energizing of the coil 10, carried out with a slight delay in respect of the energizing of the coil 5, leaves the spring 11 free to drive the annular bush element 8 out of the electromagnetic unit 1, so as to cause said element to mate with the edge of the hole 3, obstructing its clearance and thus blocking the weft yarn F against the drum.

This action stops any return oscillations eventually produced on the weft yarn F, and to thus prevent said yarn from not being stopped due to sliding thereof under the rod 4.

At the same time, the yarn turns wound on the drum are prevented from rebounds, whereby there are no turn superpositions, with great benefits as far as the correct unwinding and the exact measuring of the weft yarn.

The annular bush element 8 is then moved back into a rest position by energizing again the coil 10, which overcomes the action of the spring 11 and drives the bush back into the box housing the unit 1.

Summing up, the working steps of the electromagnetic unit according to the present invention—which follow at very short time intervals—are:

1)—Energizing of the coil 5 and consequently movement of the rod 4 to stop the weft yarn F, while the annular bush element 8 remains stationary into the box housing the unit 1 (the supplementary coil 10 is in fact energized and retains the annular bush element 9 onto its collar 9A against the action of the spring 11).

2)—De-energizing of the coil 10 and consequently movement of the annular bush element 8 (the spring 11 acting onto the annular bush element 9) to block the weft yarn F by pressing it against the winding drum.

3)—Energizing again the coil 10, with consequent return of the annular bush element 8 into a rest position inside the unit 1, against the action of the spring 11A.

4)—De-energizing of the coil 5 and energizing of the coil 6, to cause the inlet of the rod 4 into the unit 1, so as to release the weft yarn F for a new insertion thereof into the loom (in this step, the supplementary coil 10 continues, of course, to be energized).

Steps 3) and 4) could eventually follow one another in an inverted order, obtaining in this case a more positive disengagement of the weft yarn from the stopping rod 4, in the event that said yarn should tend to adhere to said rod and follow it in its return inlet stroke.

Figure 4:
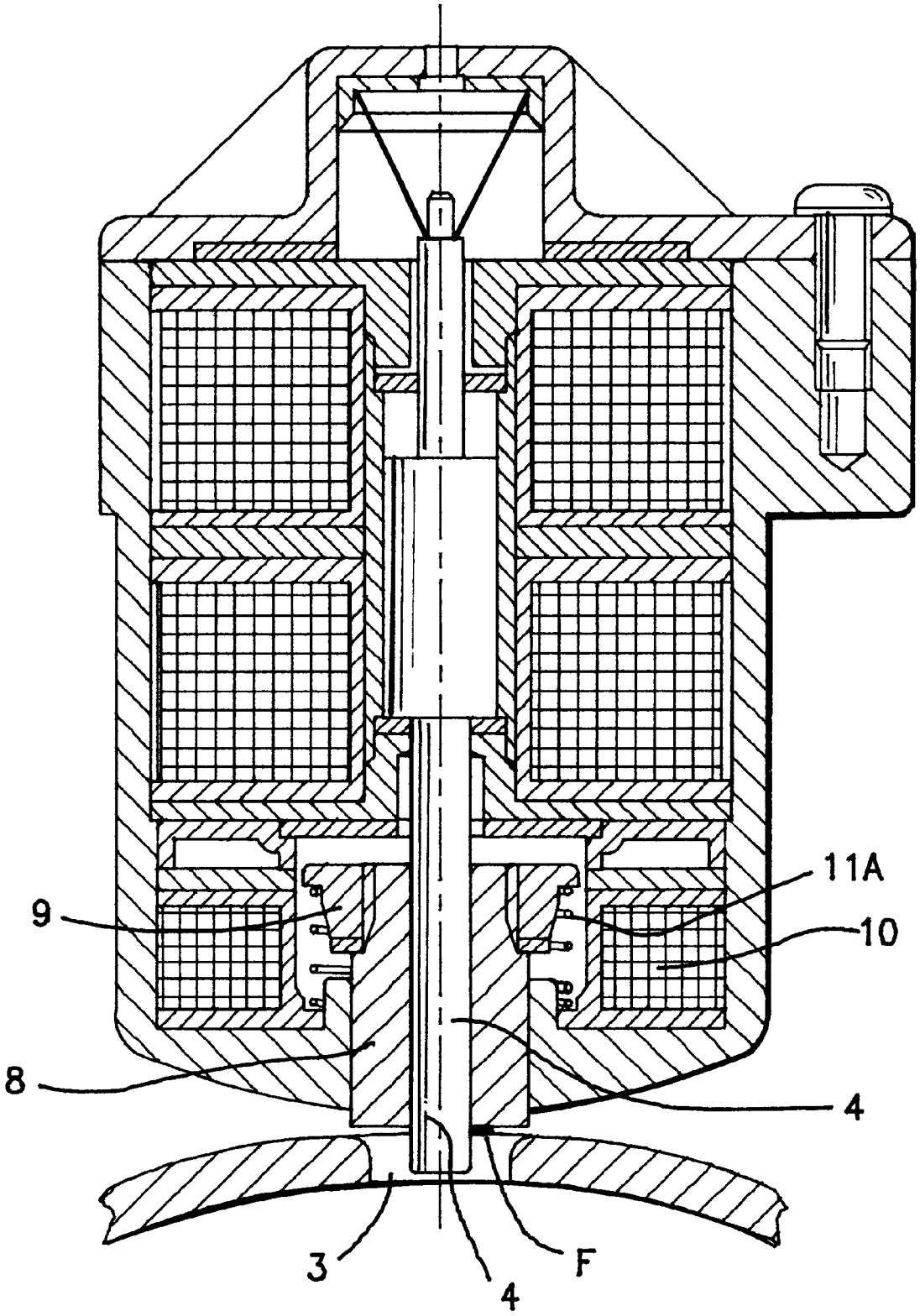
FIG. 4 is a diagrammatic axial section view of a second embodiment of the electromagnetic weft yarn stopping unit according to the present invention.

FIG. 4 illustrates another embodiment of the electromagnetic stopping unit of FIGS. 1 to 3. In this case, the spring 11A is mounted so as to return the bush 8-9 in a non-working position when the supplementary coil 10 is de-energized. Whereas, when being energized, said coil 10 causes the annular bush element 9 to slide towards the drum, thereby leading the annular bush element 8 to mate with the edge of the hole 3. There is no need to point out the working differences between this embodiment and the one described heretofore, the only substantial difference lying in the fact that, when the coil 10 is de-energized, the bush 8-9 is in a weft yarn stopping position in the embodiment of FIGS. 1 to 3, and it is instead in a position of rest in the embodiment of FIG. 4.

Figure 5:
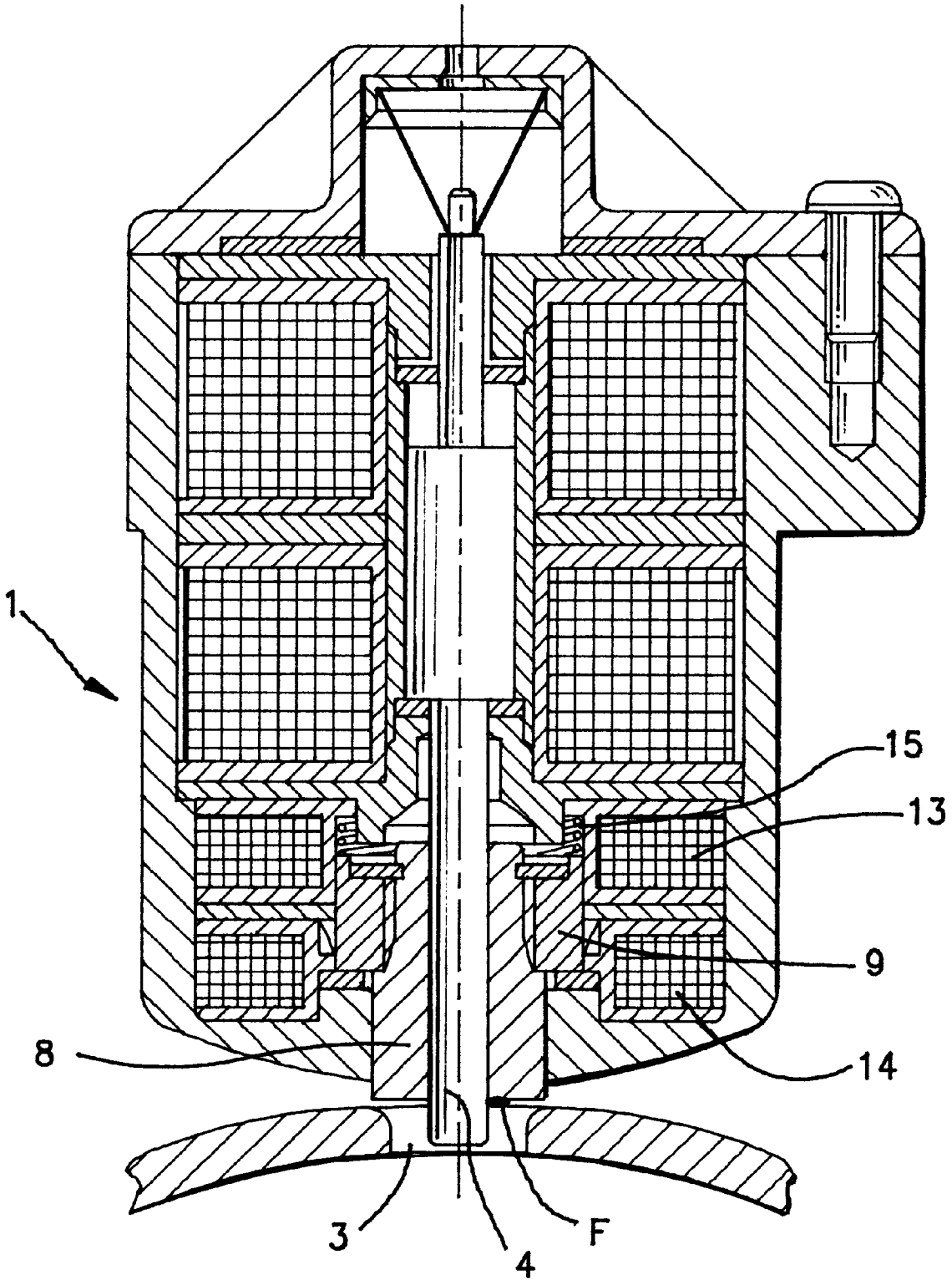
FIG. 5 is a view similar to the previous ones, showing a third embodiment of said unit.

FIG. 5 illustrates an even further embodiment of the invention, wherein the bush 8-9 is controlled by two supplementary electromagnetic coils 13 and 14, which act onto the annular bush element 9 so as to press it towards the drum and withdraw it from said drum. Thus, when the coil 13 is energized, the bush emerges from the box housing the unit 1 so as to mate, with its annular element δ, the edge of the drum hole 3; whereas, when the coil 14 is energized (and the coil 13 is deenergized), the bush 8-9 is moved back into the unit 1. The embodiment of FIG. 5 include the use of spring means, for example spring 15. A light spring could be suitably provided to cooperate with the coil 13, or with the coil 14—according to construction, assembly and operating requirements—so as to eventually improve the behavior of the electromagnetic stopping unit according to the present invention It should be noted that the aforedescribed bush element according to the present invention, coaxial to the weft yarn stopping rod, has been shown mounted onto an electromagnetic weft yarn stopping unit of the type controlled by two coils (5 and 6). It is however understood that the invention could be equally applied to different units or devices to stop the weft yarn, for instance of the type comprising a single coil, in that it is not strictly tied to the constructive typology of such devices.

Also other embodiments and modifications of the aforedescribed electromagnetic unit should of course be considered to fall within the scope of the present invention.

I claim:

1. In an electromagnetic unit to stop the weft yarn in measuring weft feeders for fluid jet looms, comprising a rod movable along its axis, under the control of at least one electromagnetic coil and adapted to insert one of its ends, with clearance, into a corresponding hole of a weft feeder drum and engage a weft yarn on one side of the rod; the improvement comprising a bush mounted on said movable rod, said bush being axially slidable under the action of a supplementary electromagnetic coil and of means opposing said coil, said bush being adapted to mate with an edge of said drum hole for insertion of said rod end into said drum hole, and being adapted for delaying the sliding of said bush towards the drum in respect of the movement of said rod towards the drum.

2. Electromagnetic unit as in claim 1, in which said opposing means consist of spring means.

3. Electromagnetic unit as in claim 1, in which said opposing means consist of a second supplementary electromagnetic coil.

4. Electromagnetic unit as in claim 3, wherein said supplementary coils are mounted on the same axis as said coil controlling the movable rod and are positioned at the end of the unit for being positioned close to a said drum.

5. Electromagnetic unit as in claim 3, wherein one of said two supplementary coils presses said bush towards the edge of said drum hole, and the other one withdraws said bush from said edge.

6. Electromagnetic unit as in claim 3, and spring means acting on at least one of said supplementary coils in order to augment the action of said at least one of said coils.

7. Electromagnetic unit as in claim 1, wherein said bush comprises a first annular element of non-magnetic material, designed to mate with the edge of the drum hole, and a second annular element of magnetic material, fixed to the first element and subject to the action of said opposing means.

8. Electromagnetic unit as in claim 7, wherein the second annular element of said bush comprises a collar adapted to be engaged by said cylindrical helical spring.

9. Electromagnetic unit as in claim 1, wherein said supplementary coil is provided to withdraw said bush from the edge of said drum hole, and said opposing means comprises a cylindrical helical spring acting on the bush so as to press it towards said edge when the supplementary coil is de-energized.

10. Electromagnetic unit as in claim 1, wherein said supplementary coil is provided to press said bush towards the edge of said drum hole, and said opposing means comprises a cylindrical helical spring acting on the bush so as to withdraw it from said edge when the supplementary coil is de-energized.

* * * * *